US005419166A

United States Patent [19]

Helman

[11] Patent Number: 5,419,166

[45] Date of Patent: May 30, 1995

[54] SECURING DEVICE FOR HANGING GARMENTS

[76] Inventor: Troy D. Helman, 400 Ohio St., Terre Haute, Ind. 47807

[21] Appl. No.: 324,347

[22] Filed: Oct. 17, 1994

Related U.S. Application Data

[63] Continuation-in-part of Ser. No. 93,787, Jul. 19, 1993, abandoned.

[51] Int. Cl.[6] ..... E05B 69/00

[52] U.S. Cl. ..... 70/59; 70/49; 70/50; 70/62

[58] Field of Search ..... 70/18, 30, 49, 58–62, 70/50, DIG. 41; 211/4, 9; 248/551

[56] References Cited

U.S. PATENT DOCUMENTS

| | | | |
|---|---|---|---|
| 564,498 | 7/1896 | Bagot et al. | 70/18 X |
| 1,503,210 | 7/1924 | Shannon | 70/18 |
| 3,568,479 | 3/1971 | Fleck et al. | 211/4 X |
| 3,647,072 | 3/1972 | Strang | 211/4 |
| 3,690,130 | 9/1972 | Eutzler | 211/4 X |
| 4,033,160 | 7/1977 | Mima | 70/49 X |
| 4,073,415 | 2/1978 | Pegg | 70/59 X |
| 4,845,967 | 7/1989 | Evans et al. | 70/18 X |
| 4,885,920 | 12/1989 | Larson | 70/49 |
| 5,156,028 | 10/1992 | Jiang | 70/30 |
| 5,291,765 | 3/1994 | Hoisington | 70/49 X |

*Primary Examiner*—Lloyd A. Gall
*Attorney, Agent, or Firm*—Thomas E. Coverstone

[57] ABSTRACT

A device for securing hanging garments that is affixed to a garment rail. The securing device has a lock box with a cable. The cable has a proximal end fastened to the lock box and a distal end that is fed through a clamp and the hanging garment to be secured. The distal cable end is then locked by a locking device in the lock box. A key is used to unlock the distal cable end when the garment is to be removed and unsecured from the garment rail. The clamp has a lever that tightens and loosens the securing device to the garment rail while secured by the cable. The securing device may be adjusted along the garment rail according to the proprietor's requirements. Such as, the securing devices may be spaced accordingly along the length of the garment rail for usage or slid to one end of the rail for segregated usage, if desired. The lock box has seals to prevent the flow of lubricants and dirt from the locking device to the distal end of the cable to prevent the cable from soiling the secured hanging garment.

4 Claims, 2 Drawing Sheets

SECURING DEVICE FOR HANGING GARMENTS

DESCRIPTION

This is a continuation in part application from Ser. No. 08/093,787 filed on Jul. 19, 1993, of HELMAN, now abandoned.

TECHNICAL FIELD

This invention relates to devices for securing hanging garments from theft when they are left unattended.

BACKGROUND ART

Wearing expensive hanging garments to a public or semi-public place carries with it the risk that the garments may be accidently or purposefully misappropriated once they are hung and left unattended. This risk of loss can detract from the pleasure that would otherwise be associated with wearing such garments in public.

Anti-theft devices for hanging garments are known in the retail garment trade, but as a group, such devices are not readily available for consumer use. Various patents for anti-theft devices attempt to address the misappropriation of hanging garments, which is assumed by the consumers of expensive hanging garments after the retail purchase. U.S. Pat. No. 3,647,072 to Strang discloses an anti-theft device for hanging garments comprising a bulky, and thus very inconvenient, mechanical locking device for locking a hanging garment to a garment rack assembly. The prior art does not allow the proprietor of the garment rack to modify the arrangement of the securing devices based on the proprietor's requirements.

What is needed is a securing device for hanging garments that may be attached to the garment rail and that may be easily adjusted to specific locations along the rail and a securing device that does not allow lubrication from the locking mechanism to soil the garment.

DISCLOSURE OF THE INVENTION

A securing device for hanging garments of the present invention provides an anti-theft device that is adjustable along the garment rail and provides a means for preventing lubrication from the locking mechanism from soiling the secured garment.

According to the present invention, the securing device comprises a lock box having a cable with a distal end and a proximal end. The proximal end is fastened to the lock box and the distal end is fed through a clamp, the hanging garment, and the lock box. The distal end is in locking contact with the lock box. The lock box has a locking mechanism that is operated by a key, which the user removes and retains after locking the hanging garment. The clamp fastens the securing device to the garment rail and allows the proprietor to easily arrange the securing device or devices according to the proprietor's requirements. Such as, the securing devices may be spaced accordingly along the length of the garment rail for usage at a first event, then the securing devices may be grouped at one end of the garment rail at a subsequent second event. The cable is fed through the clamp so that although the securing device is adjustable along the garment rail, the securing device and the hanging garment may not be removed from the garment rail.

The locking device has a primary groove and seal and a secondary groove and seal to prevent any lubrication from the locking mechanism to migrate to the locked distal cable end and, therefore, preventing the cable from soiling the secured garment.

In another embodiment, the securing device is exactly the same as described above except that the lock box may be operated with a coin activation locking mechanism, which disengages a key to the locking mechanism when the appropriate coinage is deposited therein.

The foregoing and other features and advantages of the present invention will become more apparent from the following description and accompanying drawings.

BEST MODE FOR CARRYING OUT THE PRESENT INVENTION

Figure 1:
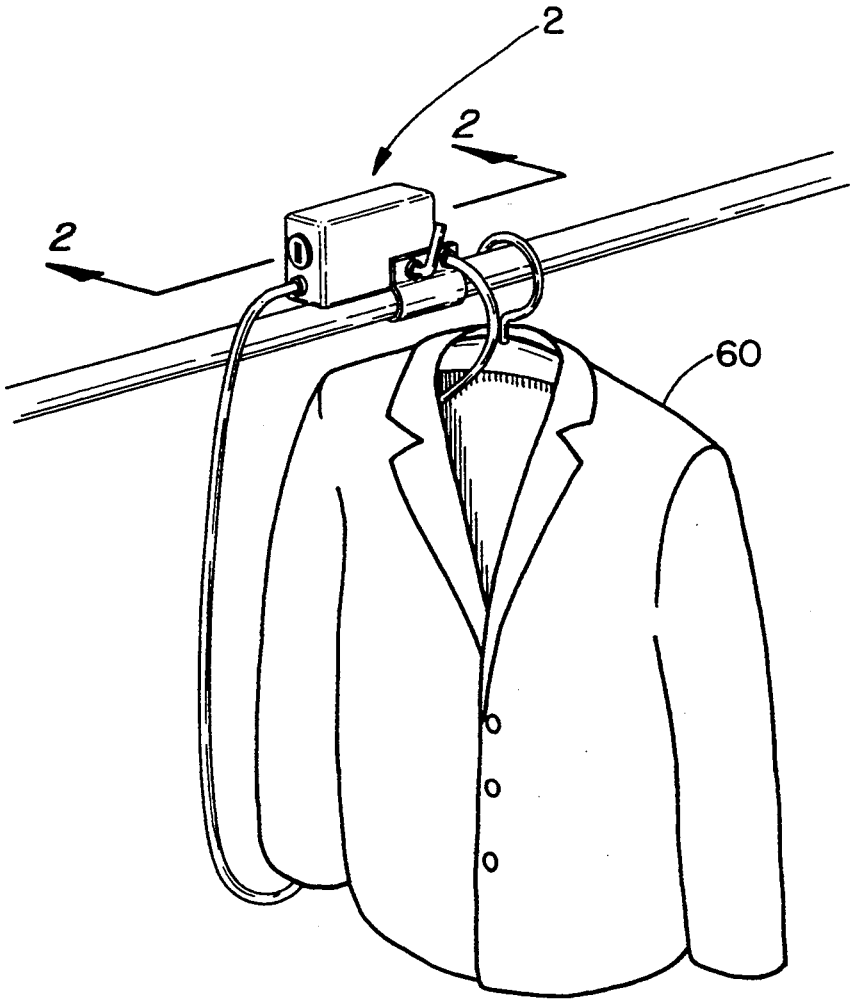
FIG. 1 is a perspective view of the present invention.
Figure 2:
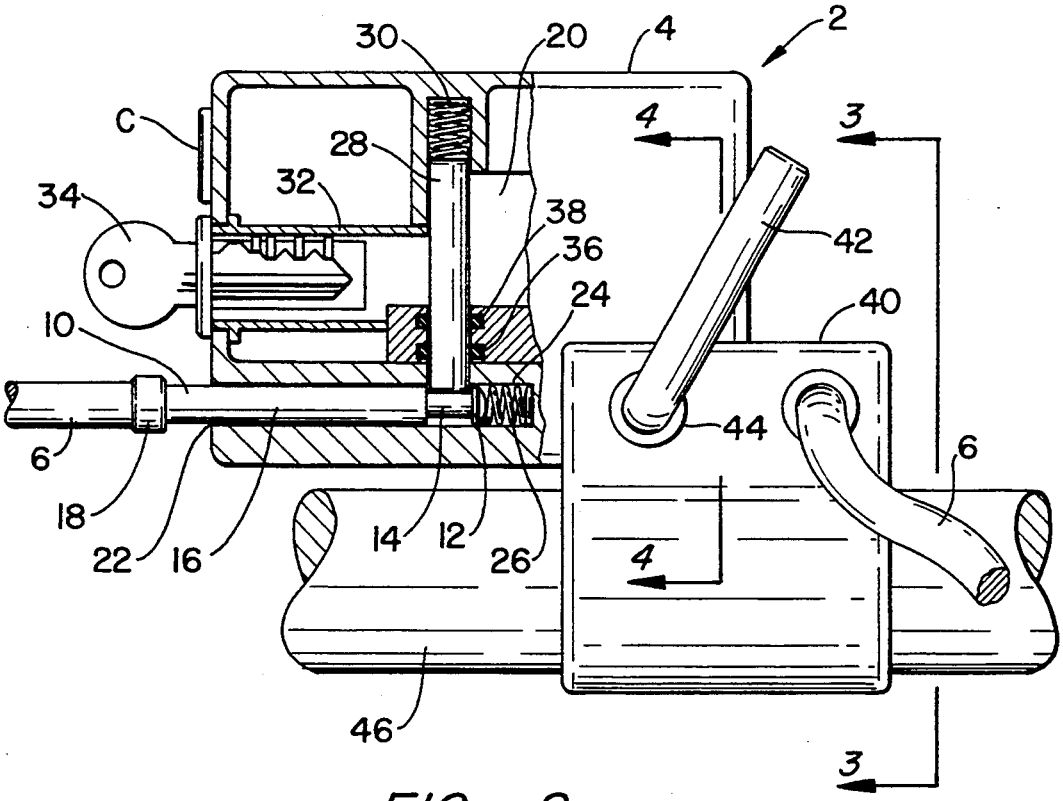
FIG. 2 is a partial cross-sectional view of the present invention taken along line 2—2 in FIG. 1.
Figure 3:
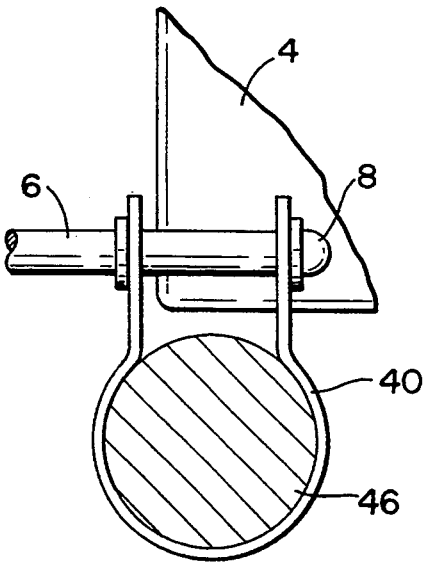
FIG. 3 is a plan view of the present invention taken along line 3—3 in FIG. 2.

According to the present invention, and as shown in FIGS. 1 and 2, a securing device 2 for securing a hanging garment 60 is provided comprising a lock box 4 and a clamp 40. As shown in FIG. 3, the lock box 4 comprises cable 6 having a proximal end 8 fastened to the lock box 4 and a distal end 10. The cable 6 and the distal end 10 are fed through the sleeve of the hanging garment 60, a button hole, or an arm opening, and the distal end 10 is then locked in the lock box 4, in effect, securing the hanging garment 60. The distal end 10 comprises a head 12 at the distal end 10 terminal point and a groove 14 adjacent to the head 12. A shaft portion 16 is adjacent to the groove 14 and a coupling 18 connects the distal end 10 to the cable 6.

The lock box 4 has a distal end receptor 22 and a lock cavity 20. The lock box 4 houses a cable spring 24 and a bit stop 26. The bit stop 26 is fastened to the cable spring 24 and is adjacent to the head 12 when the distal end 10 is inserted into the distal end receptor 22. The distal end 10 is in locking contact with the distal end receptor 22.

The lock cavity 20 houses a means for locking 32 with a bit 28 and a means for unlocking 34. The means for locking 32 and means for unlocking 34 may be an ordinary lock and key mechanism, which is described in this preferred embodiment and will be appreciated by those skilled in the art. The lock 32 controls the movement of the bit 28. The bit 28 is perpendicular to the groove 14 and in contact, or engaging with the groove 14 when the distal end 10 is in locking contact with the distal end receptor 22. A bit spring 30 is a bias to push the bit 28 into the groove 14 when the distal end 10 is inserted into the distal end receptor 22 for locking contact.

When the locking mechanism 32 is unlocked the bit 28 is raised out of the groove 14 unlocking the distal end 10 from the distal end receptor 22. The cable spring 24 is a bias to push the distal end 10 out of the distal end receptor 22 when the distal end 10 and the distal end receptor 22 are not in locking contact with each other. The bit stop 26 overcomes the bit spring 30 bias and engages and maintains the bit 28 open until the distal end 10 is again inserted into the distal end receptor 22 for locking contact. The head 12 pushes the bit stop 26 and compresses the cable spring 24 until the groove 14 is directly adjacent and perpendicular to the bit 28. The bit spring 30 pushes the bit 28, which engages the groove 14 and locks the distal end 10 into the distal end receptor 22.

Figure 4:
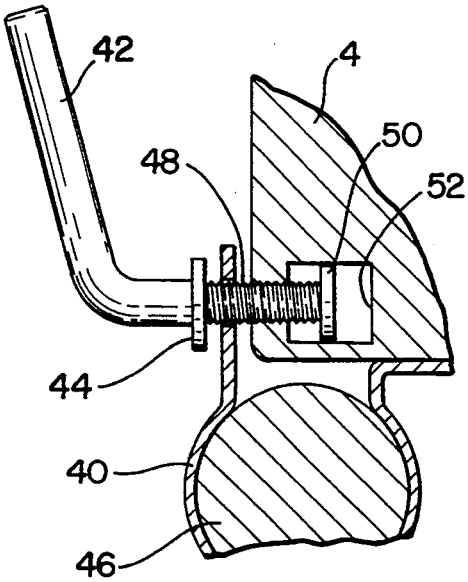
FIG. 4 is a cross-sectional view of the present invention taken along line 4—4 in FIG. 2.

Referring to FIG. 4, the clamp 40 is secured at one end to the lock box 4 and the other end is free for movement and adjustment along an existing garment rail 46. A lever 42 comprises a torque washer 44, a threaded portion 48 that is engaged and threaded into the lock box 4, and a lever stop 50, which is housed in a lever stop cavity 52. The lever stop cavity 52 is located in the lock box 4 and provides adequate space for the threaded portion 48 and lever stop 50 to travel within the lock box 4 when the clamp 40 and lever 42 are tightened. The lever stop 50 prevents the lever 42 from becoming disengaged, or un-threaded, from the lock box 4. The torque washer 44 provides an area to compress the clamp 40 against the lock box 4 while the lever 42 and clamp 40 are tightened.

Referring to FIG. 3, the proximal end 8 of the cable is fastened to the lock box 4 and is fed through the clamp 40 so that when the lever 42 and clamp 40 are loosened from the rail 46 and the securing device 2 is moved along the rail for positioning, the securing device 2 and the secured garment 60 may not be removed from the rail 46. A plurality of securing devices 2 may be spaced accordingly along the length of the garment rail 46 for usage at a first event, then the securing devices 2 may be grouped at one end of the garment rail at a subsequent second event. This feature has the advantage of allowing the proprietor to easily arrange the securing device or devices according to the proprietor's requirements while simultaneously providing constant anti-theft security for the device 2 and the hanging garment 60.

The lock box 4 houses a primary groove and seal arrangement 36 coaxially aligned with a secondary groove and seal arrangement 38. The seals are each adjacent to and in sealing contact with the bit 28. The primary and secondary seals isolate the cable 6 and the distal end 10 from any lubricants that may escape from the locking mechanism 32. Isolating the lubricants from the cable 6 prevent the hanging garment 60 from becoming soiled while the distal end 10 is fed through the sleeve of the hanging garment 60 prior to securing the hanging garment 60. The locking means may be coin operated (C-FIG. 2).

Although this invention has been shown and described with respect to a detailed embodiment thereof, it will be understood by those skilled in the art that various changes in form and detail thereof may be made without departing from the spirit and scope of the claimed invention.

I claim:

1. A device for securing a hanging garment, comprising:

a lock box having a distal end receptor, and a cable, the cable having a proximal end and a distal end, the cable proximal end securely fastened to the lock box and the cable distal end in locking contact with the distal end receptor;

the cable distal end having a head at a terminal point, and a groove adjacent to the head;

the lock box housing a cable spring, a bit stop adjacent to the head, a bit perpendicularly engaging the groove, a bit spring biasing the bit into the groove, and a locking means, so that when the distal end of the cable is engaged into the distal end receptor the head slides the bit stop past the bit and the bit spring engages the bit in the groove locking the distal end into the distal end receptor, and when a key unlocks the locking means the cable spring pushes the groove away from the bit and the bit stop engages the bit so that the distal end receptor is in an unlocked position;

the lock box further comprises a groove and seal, the seal in sealing contact with the bit and sealing the locking means lubricating oil and dirt from the cable;

a clamp secured to the lock box at one end with the proximal end of the cable fed through the clamp;

a lever having a threaded portion engaged into the lock box so that the lock box may be slid along an existing garment rack by loosening and tightening the lever and clamp while preventing the securing device from being removed from the garment rack and the secured garment from being removed from the device.

2. The securing device according to claim 1, the groove and seal further comprising a primary seal and groove and a secondary seal and groove, the seals in sealing contact with the bit and sealing the locking means lubricating oil and dirt from the cable.

3. The securing device according to claim 1, the lever further comprising a torque washer and a lever stop;

the lock box having a lever stop cavity housing the lever stop, so that the lock box may be slid along an existing garment rack by loosening and tightening the lever and clamp while preventing the securing device from being removed from the garment rack and the secured garment from being removed from the device.

4. The securing device according to claim 1 wherein the locking means is coin operated and a key is disengaged when the proper coinage is deposited into the securing device.

* * * * *